United States Patent [19]

Eldridge et al.

[11] 3,982,357

[45] Sept. 28, 1976

[54] CLEANING DEVICE FOR CAUTERIZING KNIVES

[76] Inventors: John D. Eldridge; William D. De Mayo, both of 1115 E. Elm, Fullerton, Calif. 92631

[22] Filed: Apr. 14, 1975

[21] Appl. No.: 567,627

[52] U.S. Cl. ..... 51/181 R; 15/218.1; 51/354; 128/303.17

[51] Int. Cl.[2] ..... B24B 3/54; A47L 21/00

[58] Field of Search ..... 51/330, 354, 352, 358, 51/181 R, 181 NT, 150, 151, 211, 214; 15/218.1, 210 B; 128/303, 303.17

[56] References Cited

UNITED STATES PATENTS

| | | | |
|---|---|---|---|
| 561,765 | 6/1896 | Cloud et al. | 15/218.1 |
| 651,644 | 6/1900 | Abbott | 15/218.1 |
| 836,189 | 11/1906 | Hutchinson | 15/218.1 |
| 1,096,354 | 5/1914 | Coyle | 15/218.1 |
| 1,861,683 | 6/1932 | Branch | 51/358 X |
| 2,328,832 | 9/1943 | Mock | 51/181 |
| 2,441,690 | 5/1948 | Dirksen | 51/354 |
| 2,648,858 | 8/1953 | Paull | 15/218.1 X |
| 2,826,879 | 3/1958 | Evans | 51/214 |
| 2,885,836 | 5/1959 | Robitaille | 51/214 |

*Primary Examiner*—Al Lawrence Smith
*Assistant Examiner*—Nicholas P. Godici
*Attorney, Agent, or Firm*—Lyon & Lyon

[57] ABSTRACT

A cleaning device for cauterizing knives presterilized for single surgical use and including a supporting frame adapted to be attached to a towel or drape used in surgery and held by an atraumatic clip also used in surgery, the frame containing a pair of abrasive strips having mutually engaging surfaces provided with diverging entrance ends, between which a cauterizing knife may be inserted to scrape cauterized flesh therefrom. In one embodiment, the supporting frame containing the abrasive strips also receives compressible plastic pads which applies a yieldable force pressing the abrasive surfaces into mutual contact, and also function to wipe loosely clinging material and also function as storage pads into which used blades may be thrust for later use or discard. In another embodiment, magnets urge the abrasive surfaces into mutual yieldable engagement. A further embodiment is arranged to clean cauterizing forceps as well as knives.

15 Claims, 15 Drawing Figures

CLEANING DEVICE FOR CAUTERIZING KNIVES

BACKGROUND AND SUMMARY OF THE INVENTION

Cauterizing knives, intended to be discarded following an operation, are used extensively. Often cauterized flesh clings to the knives requiring an excessive amount of time for cleaning by conventional means.

The present invention is directed to a sterilized cleaning device for cauterizing knives or forceps intended for use during a single operation then to be discarded, and is summarized in the following objects:

First, to provide a cleaning device for cauterizing knives or forceps which is arranged for attachment to a surgical towel or drape by an atraumatic clip in position for ready use.

Second, to provide a cleaning device, as indicated in the other objects, embodiments of which utilizes a pair of confronting abrasive strips urged into mutual engagement by opposed resilient porous pads which also service to wipe loosened particles from the cauterizing knife or forcep, to receive new or used knives or forceps for temporary storage during surgery, and to collect used knives for discard after surgery.

Third, to provide a cleaning device, as indicated in the other objects, an embodiment of which utilizes magnet elements to urge the abrasive strips into mutual engagement.

Fourth, to provide a cleaning device, as indicated in the other objects, wherein the mutually engageable abrasive strips are so arranged that the cauterizing knife may be inserted axially and reciprocated or may be passed laterally therebetween to prevent withdrawal of the knife from its holder.

Fifth, to provide a cleaning device, as indicated in the other objects, which includes a frame structure receiving the abrasive strips and pads, and is further provided with side extensions for clamping engagement by an atraumatic clip for attachment to a surgical towel or drape; the frame also being provided with yieldable channels adapted to form additional means for receiving cauterizing knives or an excess portion of an electrical cord forming a part of the cauterizing equipment, or retain extraneous surgical items such as drain tubes.

Sixth, to provide a cleaning device, particularly adapted for use by cauterizing forceps, wherein abrasive is provided on opposite sides of a pad supported by a central web so that the blades of the forceps may be pressed toward each other to wipe cauterized material therefrom, and wherein portions of the pad are exposed to wipe residual loose particles from the forceps.

Figure 1:
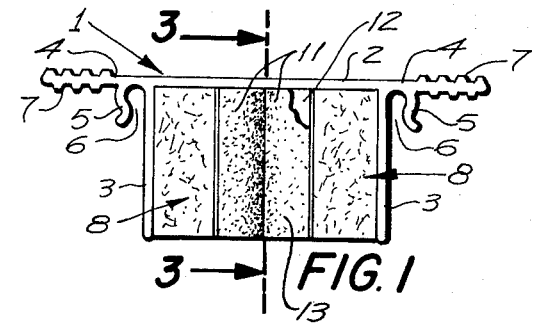
FIG. 1 is an end view of one embodiment of the cleaning device for cauterizing knives.
Figure 6:
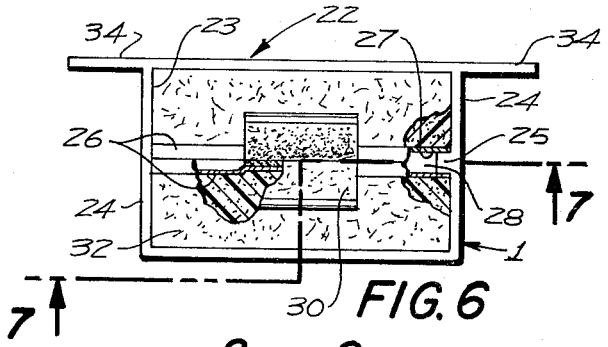
FIG. 6 is an end view similar to FIG. 1, showing a second embodiment of the cleaning device, with portions shown in section.

Referring first to the embodiment shown in FIGS. 1 through 5, the cleaning device includes a frame structure 1 which may be in the form of an extrusion cut to length. The frame structure includes a base plate 2, having parallel flanges 3 and laterally extending side webs 4. The side webs are provided, adjacent each flange 3 with a rib 5 forming with the adjacent flange 3 an implement receiving channel 6. Outwardly from the ribs 5 the side webs 4 are provided with grooves surfaces 7, or are otherwise provided with an irregular surface.

Received between the flanges 3 is a pair of confronting porous plastic pads 8 which are cemented to the flanges 3 and are in a compressed condition exerting a force toward each other. At one end the pads diverge from each other as indicated by 9.

Cemented to the confronting portions of the pads 8 is a pair of abrasive strips 10 having diverging portions 11, conforming to the diverging portions 9. Each abrasive strip 10 includes a back lamination 12 cemented to the corresponding pad 8 and covered with an abrasive lamination 13. Below the diverging portions 11 the abrasive lamination 13 are forced into mutual contact by the expansive force exerted by the plastic pads 8.

In place of a back lamination of paper or cloth and an abrasive lamination such as sand paper or cloth or emery paper or cloth, the abrasive strips may be formed of thin gaged metal, the surface of which has been etched or otherwise treated to provide a hard abrasive surface.

Figure 5:
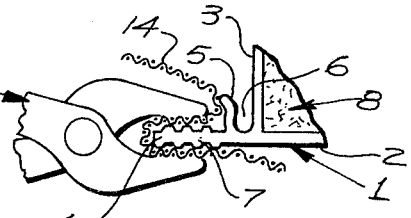
FIG. 5 is a fragmentary view, showing the manner in which the cleaning device is secured to a towel or drape by an atraumatic clip.

The embodiment shown in FIGS. 1 through 5 functions as follows:

The frame structure is secured to a surgical towel or drape 14, as indicated in FIG. 5, by means of atraumatic clip 15. The cauterizing knife 16 includes a handle 17 and an expendable knife blade 18 having a portion 19 of circular cross section for insertion into the handle 17. The handle 17 is connected to an appropriate electrical source by a cord 20.

Figure 3:
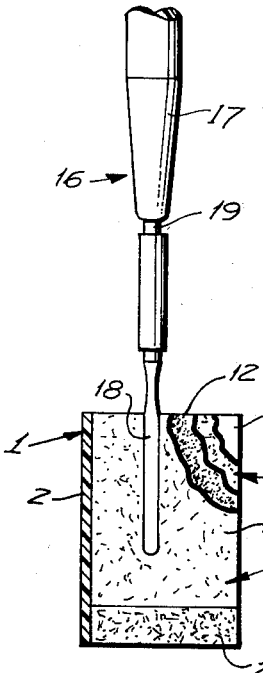
FIG. 3 is a sectional view taken through 3—3 of FIG. 1, showing a cauterizing knife being cleaned by longitudinal movement.
Figure 4:
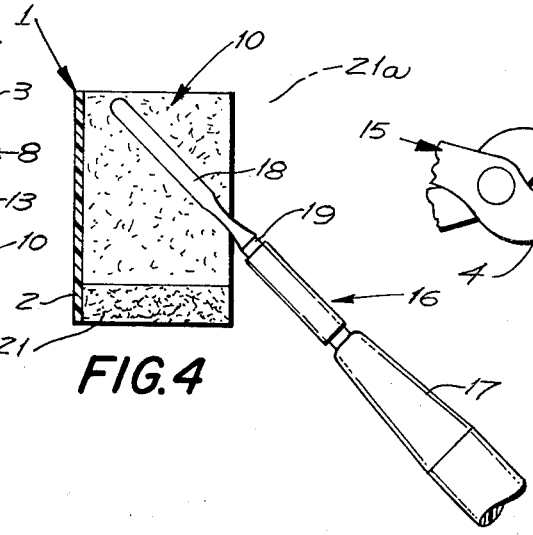
FIG. 4 is a similar sectional view showing a cauterizing knife being cleaned by transverse movement.

The cleaning operation is accomplished by inserting the knife blade 18 endwise between the abrasive strip 10, as shown in FIG. 3, or may be moved laterally as shown in FIG. 4, or a combination of both movements may be used. It has been noted that in some cases the friction engagement between the handles 17 and the circular portion 19 of the knife blade 18 may be such that endwise movement as shown in FIG. 3 may cause the blade to be withdrawn from the handle. Another advantage in wiping the blade laterally as shown in FIG. 4, is that the abrasive strips 10 may terminate short of the pads 8 so that beyond the abrasive strips the pads 8 are in mutual contact as indicated by 21. Also the pads may extend laterally beyond the abrasive strips as indicated by broken lines in FIG. 4, designated 21*a*. With either or both arrangements cauterized remnants loosened from the knife blade by the abrasive strips may be wiped free from the knife blade and retained by the pads.

Such final cleansing may also be accomplished by insertion of the knife blade endwise into the pads exposed on either side of the abrasive strips. The knives may be inserted parallel to the direction of the abrasive strips of transversely thereto.

The cleansing device is, of course, sterilized before use so that during the course of the operation the knifes may be temporarily stored in the pads 8, either in a condition free of the handle 17 or in a condition supporting the handle. When the operation is completed the knifes may be inserted in the pad for disposal.

Figure 2:
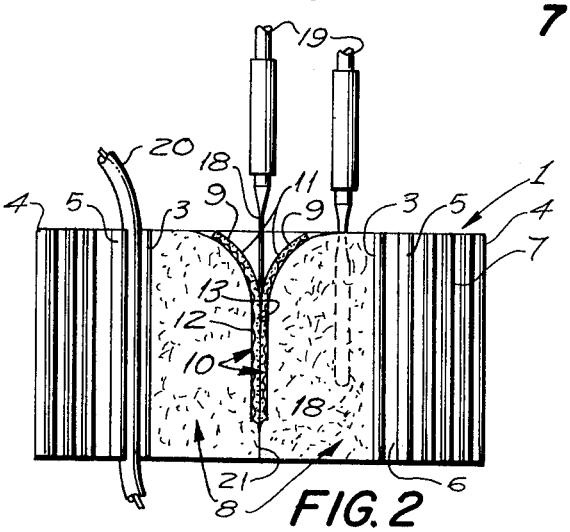
FIG. 2 is a front view thereof, showing a cauterizing knife as it appears when being cleaned, and a second cauterizing knife as it appears when being stored.
Figure 7:
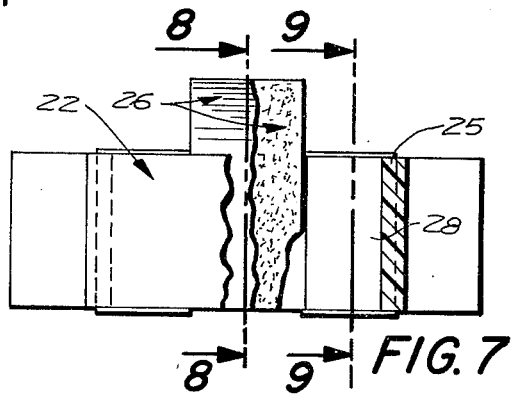
FIG. 7 is a partially front view, partially sectional view taken through 7—7 of FIG. 6.
Figure 8:
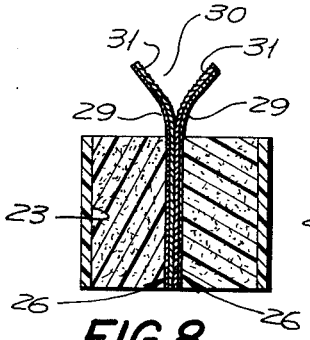
FIG. 8 is a transverse sectional view taken through 8—8 of FIG. 7.
Figure 9:
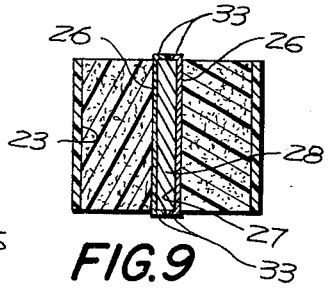
FIG. 9 is a transverse sectional view taken through 9—9 of FIG. 7.

In addition to the pads 8 the channels 6 may be utilized for blade storage and in some cases it is desired to secure an excess length of cord 20, as indicated in FIG. 2.

Referrences now directed to FIGS. 6 through 9. This embodiment of the cleaning deivce includes a frame structure 22, which includes a rectangular enclosure 23, having end walls 24 provided with a pair of ribs 25 disposed in alignment.

Extending between the ribs 25 is a pair of holder members 26 disposed in confronting relation and forming adjacent each rib 25 a magnet pocket 27 which receives magnet 28. Between the pockets 27 the holder members form the pair of abrasive strip backing laminations 29 which project above the frame structure and extend in diverging relation as indicated by 30. The surfaces of the laminations 29 are provided with abrasive laminations 31 similar to the abrasive laminations 13 of the first described embodiment. The enclosure 23 on opposite sides of the holder members 26, receive a pair of porous plastic pads 32, which may be similar to the pads 8. The pads 32 may be compressed and in any case are cemented in place.

The cleaning operation performed by the embodiment shown in FIGS. 6 through 9 is essentially the same as that described in connection with FIGS. 1 through 5, except that the knife blade 18 must be inserted axially rather than laterally as shown in FIG. 4. The holder members 26 are formed of magnetic material so that they form with the magnets 28, a magnetic circuit suitably forcing the holder members toward each other. The holder members 26 are movable away from the ribs 25 as required to insert a knife blade between the abrasive laminations 31.

The holder members may be cemented into the pads 32 so as to be retained within the enclosure 23. Or such retention amy be attained by folded margins 33 which overlap the end of the ribs 25, such margins also serving to retain the magnet in place.

The frame structure 22 may be provided with side webs 34, which although shown as flat elements, may be provided with ribs corresponding to the ribs 5 of the first described embodiment, as well as grooved surfaces 7.

It should be noted that a pressure sensitive tape may be applied over and beyond the surfaces 7 to secure the cleaning device in place; alternatively the underside thereof may be provided with a pressure sensitive coating initially covered with a removable non-adhesive lamination.

Figure 10:
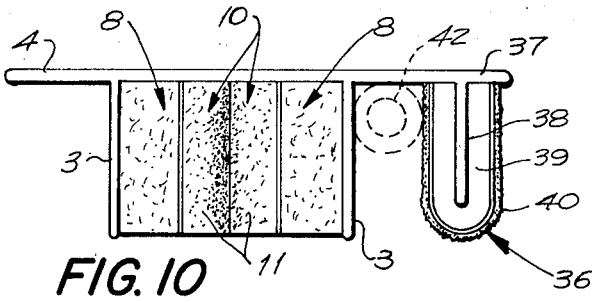
FIG. 10 is an end view of an embodiment of the cleaning device including means for cleaning confronting sides of a pair of forcep blades.

Referring to FIG. 10, the embodiment here shown similar to FIG. 1 except that a forcept cleaning unit 36 is added. This is accomplished by extending one of the side webs to form a side web 37 which is provided with an additional flange 38. The flange 38 receives a folded pad lamination 39 covered by an abrasive strip 40.

Figure 11:
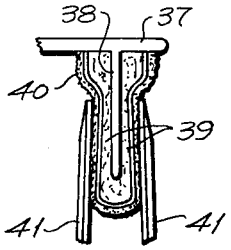
FIG. 11 is a fragmentary end view thereof showing a pair of forcep blades being cleaned.
Figure 12:
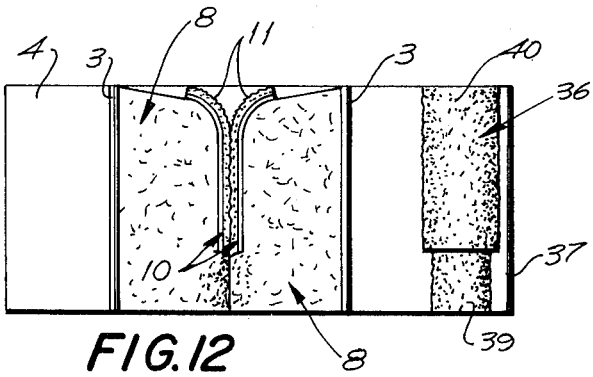
FIG. 12 is a front view of the embodiment shown in FIGS. 10 and 11.

The blades of a forcep 41 may be wiped on opposite sides as shown in FIG. 11. The folded abrasive strip 40 may terminate short of the pad lamination 39, as shown in FIG. 12, so that material loosened by the abrasive strip may be wiped off. If the outer sides of the forcep blades need cleaning, they may be pressed together and inserted between the abrasive strips 11 with or without being rotated.

Figure 13:
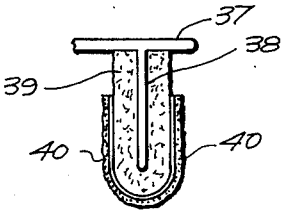
FIG. 13 is a fragmentary end view similar to FIG. 11, showing a modified arrangement of the forcep cleaning means.

The folded abrasive strip 40 may extend the full depth of the pad lamination 39 or terminate short as indicated in FIG. 13. Also the forcep cleaning unit 36 may be spaced from the adjacent flange 3 so that an extraneous surgical item such as a drainage tube 42, indicated by broken lines in FIG. 10, may be retained.

Figure 14:
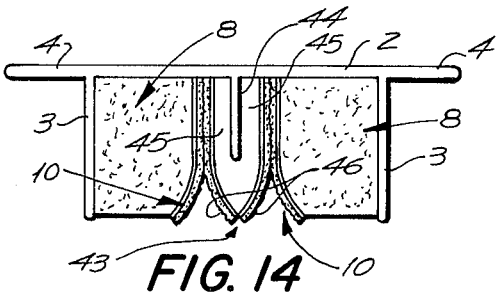
FIG. 14 is an end view showing a further embodiment of the cleaning device arranged for reception of either cauterizing knives or forceps.
Figure 15:
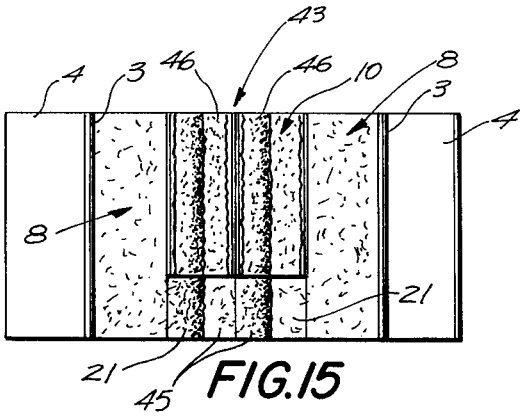
FIG. 15 is a front view thereof.

Referring to FIGS. 14 and 15, the abrasive strips 11, and the pads 8 may be spread apart to receive a forcep cleaning unit 43, including a flange 44 extending from the plate 2, and covered by a pad 45 and abrasive strips 46. In this case the extended portions are shown as converging in a curve to form a ridge and the abrasive strips 46 are similarly curved and converging.

In this embodiment the abrasive strips 11 and 46 function as the pair of strips 11 in FIG. 1, to clean cauterizing knives. A cauterizing forcep is cleaned by inserting its two blades simultaneously between the two sets of abrasive strips 11 and 46.

Portions of the pad 45 may extend beyond the strips 46 to confront the portions 21 of the pads 3 so that either a single knife blade or the pair of forcep blades may be wiped.

Also, it should be noted that the side webs 4, or 37 may be provided with the ribs 5, channels 6 and grooved surfaces as in the embodiment shown in FIGS. 1 through 4.

Having fully described our invention it is to be understood that we are not to be limited to the details herein set forth, but that our invention is of the full scope of the appended claims.

We claim:

1. A cleaning device for surgical cauterizing implements including cauterizing knives and cauterizing forceps, comprising:

a. a pair of abrasive elements disposed in yieldable mutual contact to receive cauterizing implements therebetween to abrade cauterized flesh therefrom;

b. and a porous penetrable plastic pad contiguous to the abrasive elements to receive cauterizing implements for wiping loosened cauterized remnants therefrom, said pad also forming a storage means for cauterizing implements and to aid in surgical count thereof.

2. A cleaning device for surgical cauterizing implements including cauterizing knives and cauterizing forceps, as defined in claim 1, wherein:

a. a means having opposed abrasive surfaces is mounted in spaced relation to the abrasive elements for opposed engagement by the confronting surfaces of a pair of spaced cauterizing forcep blades, the outer surfaces of the blades, when pressed together, being receivable between the abrasive elements.

3. A cleaning device for surgical cauterizing implements including cauterizing knives and cauterizing forceps, as defined in claim 1, wherein:

a. at least two pair of said pads are provided, to receive simultaneously therebetween a pair of spaced, cauterizing forcep blades, and to receive individually said forcep blades, when pressed together, or a cauterizing knife.

4. A cleaning device for cauterizing implements, as defined in claim 1, wherein:

a. a supporting frame is provided;

b. and a pair of said pads are compressed between the abrasive elements and the supporting frame to urge the abrasive elements into mutual engagement.

5. A cleaning device for cauterizing implements, as defined in claim 4, wherein:

a. the pads extend beyond portions of the abrasive elements and in yieldable mutual contact to wipe and retain loosened cauterized remnants therefrom as the cauterizing implements are withdrawn from the abrasive elements.

6. A cleaning device for cauterizing implements as defined in claim 1, wherein:

a. a supporting frame for the pad and abrasive elements is provided and includes projections for attachment to a surgical towel or drape by a surgical clip.

7. A cleaning device for cauterizing implements as defined in claim 1, wherein:

a. a magnet means urges the abrasive elements into yieldable mutual contact.

8. A cleaning device for surgical cauterizing implements, comprising:

a. a mounting frame including means for temporary attachment during surgery to a surgical towel or drape;

b. a pair of abrasive elements having mutually engageable abrasive surfaces;

c. a pair of yieldable porous pads supported by the frame and receiving the abrasive elements therebetween in yieldable mutual contact to receive and permit movement of a cauterizing implement therebetween, for abrading cauterized flesh therefrom, the abrasive elements including diverging portions to facilitate entrance of the cauterizing implements therebetween; said pads being accessible for penitration by the cauterizing implements to effect removal of loosened cauterized remnants.

9. A cleaning device for cauterizing implements, as defined in claim 8, wherein:

a. portions of the pads extend beyond the abrasive elements and in mutual contact to provide additional means for wiping loosened cauterized remnants from the cauterizing implement.

10. A cleaning device for cauterizing implements, as defined in claim 8, wherein:

a. magnet means interposed between the pads supplement the force urging the abrasive elements toward each other.

11. A cleaning device for cauterizing implements, as defined in claim 8, wherein:

a. the temporary attachment means is a web projecting laterally from the mounting frame and provided with a friction enhancing surface to prevent slippage, when clamped to surgical towel or drape.

12. A cleaning device for cauterizing implements, as defined in claim 8, wherein:

a. the mounting frame includes yieldable channel means for receiving surgical items.

13. A cleaning device for cauterizing implements, comprising:

a. a mounting frame including a base wall, a pair of spaced confronting walls, and at least one mounting web having a friction enhancing surface for temporary attachment by a clamp to a surgical towel or drape during surgery;

b. a pair of pad members formed of penetrable porous material;

c. a pair of abrasive strips attached to the pad members;

d. the pad members being compressed between, and adhered to the confronting walls to position the abrasive strips between the pad members and to urge the abrasive strips into yieldable mutual contact for receiving and permitting movement of a cauterizing implement therebetween for abrading cauterized flesh therefrom, the abrasive strips including diverging portions to facilitate entrance of the cauterizing implements;

e. the pad members being penetrable by cauterizing implements for wiping loosened cauterized remnants, and for surgical storage.

14. A cleaning device for cauterizing implements, as defined in claim 13, wherein:

a. the abrasive strips are accessible to a cauterizing implement moved endwise or sidewise between the diverging portions.

15. A cleaning device for cauterizing implements, as defined in claim 14, wherein:

a. portions of the pad members extend beyond the abrasive strip to form mutually engageable portions adapted to receive a cauterizing implement therebetween for wiping loosened cauterized remnants.

* * * * *